United States Patent [19]

Aboelfotoh et al.

[11] 4,083,614

[45] Apr. 11, 1978

[54] METHOD OF MANUFACTURING A GAS PANEL ASSEMBLY

[75] Inventors: M. Osama Aboelfotoh, Poughkeepsie; Kyu Chang Park, Yorktown Heights, both of N.Y.

[73] Assignee: International Business Machines Corporation, Armonk, N.Y.

[21] Appl. No.: 736,802

[22] Filed: Oct. 29, 1976

[51] Int. Cl.[2] ..... H01J 9/02

[52] U.S. Cl. ..... 316/19; 316/20

[58] Field of Search ..... 316/19, 20, 26, 1; 29/25.13, 25.14, 25.15

[56] References Cited

U.S. PATENT DOCUMENTS 3,863,089 1/1975 Ernsthausen et al. ..... 313/220 X

OTHER PUBLICATIONS

"Making a Well Defined MgO Layer for Use in an AC Gas Panel", by J. M. Eldridge et al. in IBM Technical Disclosure Bulletin, vol. 16, No. 1, June 1973.

*Primary Examiner*—Richard B. Lazarus
*Attorney, Agent, or Firm*—Joseph J. Connerton

[57] ABSTRACT

A method is disclosed for the fabrication of a gas panel assembly with improved static and dynamic operating margins which includes depositing arrays of parallel lines as electrical conductors on a pair of glass plates, providing a dielectric layer over the parallel lines, baking out the respective glass plates in vacuum to eliminate residual gasses or impurities, depositing a layer of electron emissive refactory material over the dielectric of the glass plate assemblies at a prescribed elevated temperature range, and spacing the glass plates a specified distance apart with their arrays substantially orthogonal. This assembly is subsequently fired in an oven to seal the glass plates about their periphery while providing a chamber therebetween, the chamber evacuated and filled with an illuminable gas, the parallel lines at one end of each glass plate exposed for electrical contact and the electrical characteristics of the panel tested after fabrication.

8 Claims, 2 Drawing Figures

METHOD OF MANUFACTURING A GAS PANEL ASSEMBLY

CROSS REFERENCE TO RELATED APPLICATIONS

U.S. Application Serial No. 703,382 (IBM Docket YO9-73-059XX) "Glass Layer Fabrication" by K. C. Park et al filed July 7, 1976 and assigned to the assignee of the instant invention.

U.S. Application, Ser. No. 372,384 (IBM Docket Ki9-69-004XX) for "Improved Method and Apparatus for a Gas Display Panel" filed by Tony N. Criscimagna et al June 21, 1973 and assigned to the assignee of the instant invention.

U.S. Application, Ser. No. 405,205 (IBM Docket Ki9-71-015X) for "Gas Panel Fabrication" filed by Peter H. Haberland et al Sept. 24, 1974, now U.S. Pat. No. 3,837,724 and assigned to the assignee of the instant invention.

BACKGROUND OF THE INVENTION

This invention relates to gaseous discharge panels and more particularly to an improved method of constructing a gaseous discharge display/storage device which provides significant improvements in both the static and dynamic margins of the device while increasing the stability of the operating voltage of the device.

In the fabrication of gas panel assemblies, parallel metal electrodes are deposited onto the surface of a glass plate or substrate and a layer of insulating glass dielectric frit or slurry applied over the surface of the conductors to provide a smooth film of substantially uniform thickness across the entire surface. When the glass plates have been cooled, an overcoat layer of a refractory secondary emissive materials such as MgO (magnesium oxide) is evaporated over the dielectric layer by inserting the panel into a vacuum chamber for the evaporation. The refractory aspect prevents sputtering of the dielectric by ion bombardment, while the high secondary emission permits lower operating voltages. The plates are then edge sealed to form a chamber which is controlled to provide a uniform gap across the entire display area of the panel. Conventionally, the panel is then baked in vacuum to eliminate impurities and residual gasses including water vapor from the surface of the dielectric. Such a bakeout cycle is a time consuming operation in that approximately 16 hours is required to raise the panel to the desired temperature, maintain it at this temperature for 5 hours and then reduce the temperature from an elevated to room temperature such that a substantial length of time is involved in this aspect of fabrication. After baking, the panel is backfilled with a gas capable of emitting light in response to an electric voltage applied simultaneously to the orthogonally disposed conductors. When the panel fabrication has been completed, the electrical parameters are stabilized by a burn-in cycle in which all cells in the panel are turned on for a period of 7 hours at a specified voltage and frequency. The static operating margin of the panel, i.e., the difference between the maximum sustain voltage ($V_s$ max.) and minimum sustain voltage ($V_s$ min.) required to sustain the lines in the panel is then tested. During normal panel operation, or under test, the maximum and minimum sustain voltages defining the static margin of the panel tend to converge, effectively destroying the operating margin and reducing the yield of the panels thus fabricated thereby significantly raising the cost.

SUMMARY OF THE INVENTION

In accordance with the present invention, the magnesium oxide overcoat is applied to a heated substrate at a temperature ranging between 200° C– 400° C. When thus deposited, the magnesium oxide film is changed from the porous and highly strained coating of the prior art to a dense and strain-free film. The term "strain", as applied herein, defines the strain of the bond between the magnesium ions and oxygen ions in the magnesium oxide. When strained, MgO absorbs water. Using a heated substrate for the MgO deposition, an extremely minuscule amount of water vapor is developed in the MgO, and the film was less reactive to water vapor. Upon testing the operating margin of panels fabricated in this manner, it was noted that the maximum sustain voltage remained substantially uniform or increased slightly, while the minimum sustain voltage remained substantially constant such that both the static and dynamic margin of the panel remained uniform or even increased. A panel constructed in accordance with the teaching of the instant invention required a bakeout cycle of 150° for 5 hours, as compared to the conventional cycle of 300° for 16 hours described heretofore, such that a time consuming operation of the prior art was significantly reduced to one-third of the required time. In addition, the burn-in period was modified from 7 hours at 135 volts to one hour at 135 volts, an additional significant saving in time and cost. Finally, panels fabricated in the above described manner maintain a stable operating point such that apparatus or circuitry required to adjust the operating point of the tube to compensate for variations in margin during operation were eliminated.

Accordingly, a primary object of the present invention is to provide an improved method of mass-producing reliable gas discharge panels to reduce the per unit cost and increase the yield of manufacturing of these devices.

Another feature of the present invention is to provide an improved fabrication technique for gas discharge panels in which a coating of magnesium oxide is applied over the dielectric of a heated substrate to maintain substantially uniform static and dynamic operating margins.

Another object of the present invention is to provide an improved method of fabricating gas discharge panels which provides significant reductions in two of the time consuming operations in gas panel fabrication.

The foregoing and other objects, features and advantages of the invention will be apparent from the following more particular description of the preferred embodiment of the invention as illustrated in the accompanying drawings.

DESCRIPTION OF THE PREFERRED EMBODIMENT

Figure 1:
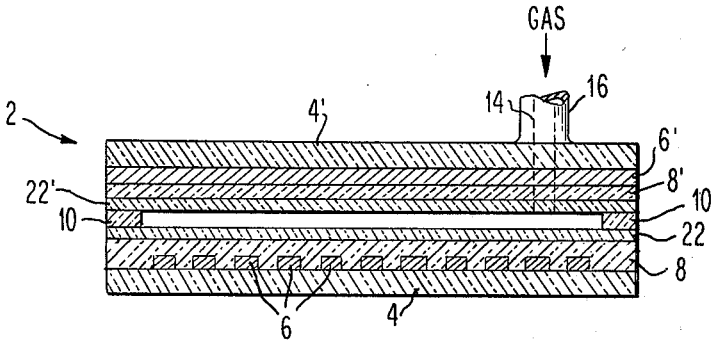
FIG. 1 is a schematic diagram of a gas panel constructed in accordance with the teachings of this invention.

Referring now to the drawings and more particularly to FIG. 1 thereof, a typical gas panel display unit consists of a pair of substrates 4 and 4' on which orthogonal conductor arrays 6 and 6' have been formed. Dielectric layers 8 and 8' are formed over their associated conductor arrays by spraying dielectric material such as lead-borosilicate glass frit over the conductor arrays, and reflowing the frit in an oven cycle to form a smooth substantially uniform dielectric layer over the entire panel surface to insulate the conductors from contact with the gas. In the normal operation of a gaseous discharge device, signals of write amplitude are applied across selected orthogonal conductors whereby the gas between the selected conductors is ionized to emit light. The light emission is sustained by sustain signals applied to all conductors which continuously reverse the polarity of the rectangular waveform applied to the conductors. The sustain signals plus the wall charge voltages combine to produce successive discharges as the polarity of the sustain signals reverse. The ionization of the gas thus produced causes the ions to be attracted to the negative conductors and the electrons to the positive conductors, the greater mass ions causing sputtering of the dielectric layer as they impact the surface. This phenomenon is known in existing gaseous discharge devices. It is also known in the art to overcoat conductors with an alkaline earth/metal oxide to lower the operating voltage of gaseous discharge devices. One secondary emissive material, magnesium oxide, is a refractory material which functions to protect the surface of the dielectric against sputter, and is also a secondary emissive material which permits lower operating potentials due to the secondary emission phenomenon. For a more detailed description of the operation of gaseous discharge devices, reference is made to the aforereferenced Criscimagna et al. application Ser. No. 405,205.

Accordingly, magnesium oxide layers 22 and 22' are formed over dielectric layers 8 and 8' by a technique more fully described hereinafter. The two plates are secured in position through sealing devices 10, which may represent rods of sealing glass placed between the panels, and weights (not shown) are placed on the upper plate 4' during the sealing cycle to enhance the fusing of the two plates when the sealing glass 10 is heated during another oven cycle. Likewise, when required although not shown in FIG. 1, spacer rods or other spacing devices may be utilized to maintain a uniform discharge gap within the chamber.

An opening 14 is drilled through the upper glass plate assembly to the gap of the panel, and a tube 16 is glass soldered to that opening to permit evacuation and backfill of the panel with an ionizable gas during subsequent fabrication. A Penning mixture of neon and 0.1% argon gas or other suitable gas mixture is inserted through the tube to the panel at a pressure of between 350–500 Torr. After the bake out cycle heretofore described, the panel is backfilled with this ionizable gas, the opening 14 is sealed off by tipping off the tube 16 and suitable interconnections are provided for edge connecting the orthogonal drive lines to the driving source so that appropriate write, sustain or erase signals can be applied to the discharge panel. For a more thorough description of the fabrication of gaseous discharge devices, attention is directed to the aforereferenced U.S. Pat. No. 3,837,724.

Figure 2:
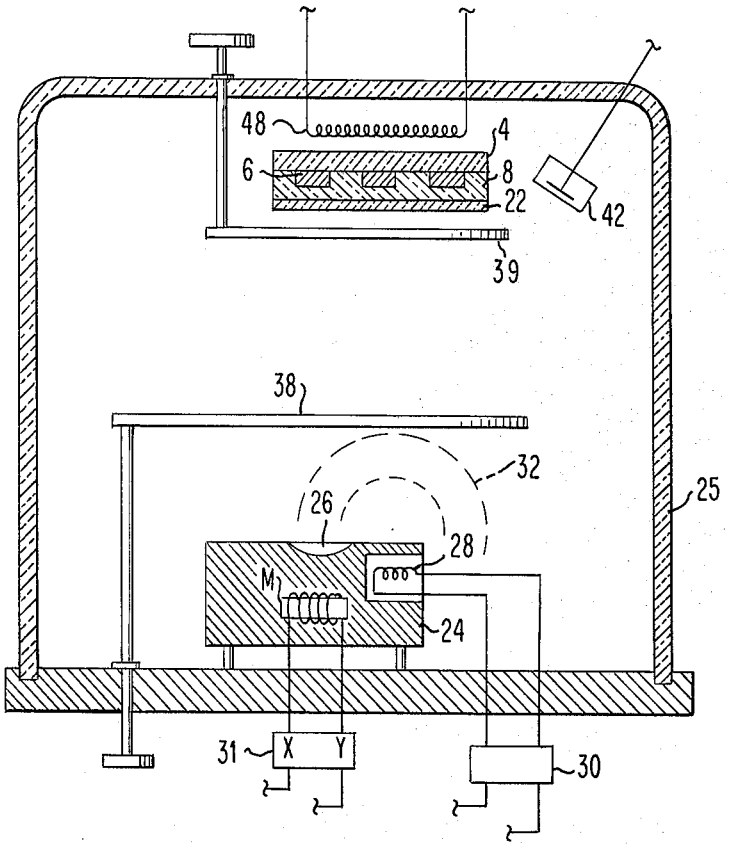
FIG. 2 is a schematic showing of an evacuation chamber and associated evaporation system for depositing the magnesium oxide layer over the dielectric coating of the plates which are subsequently sealed to form the gaseous disply panel.

Referring now to FIG. 2, there is illustrated a system for depositing the magnesium oxide layer on a heated substrate. The system consists of an evacuated chamber 25 in which depositions of the magnesium oxide layers 22 and 22' take place during the pump-down cycle. Within the chamber 25 is a copper boat 24 into which chunks of magnesium oxide single crystal source 26 are placed. A tungsten filament 28 within the boat housing is connected to a source of electrical energy for heating the filament 28. The electrons emitted from filament 28 are attracted along the path 32 by a magnet M within the boat 24 onto the source material 26, heating the latter. An X-Y sweep control unit 31 provides for longitudinal beam positioning and for automatic control of both longitudinal and lateral electron beam sweeping so as to uniformly heat a large surface area of the source material 26. Shutter 38 is interposed therebetween to permit the source material 26 to coat the assembly of the plate 4 with its associated metallurgy 6 and dielectric 8 with an MgO layer 22 (FIG. 1) emanating from source 26. Deposition of the magnesium oxide layer 22 over the dielectric layer 8 is carried out by opening shutter 38 during the evaporation of desired amounts of MgO. The magnesium oxide source 26 is bombarded with electrons from its electron filament source 28. During deposition of the magnesium oxide layer in the manner above described, the thickness of the deposited layer 22 is monitored by a detector 42, while heater 48 maintains the substrate 4 at the desired elevated temperature range between 200°–400° C. during the deposition of the magnesium oxide layer 22. For a more detailed description of the operation of the deposition process, reference is made to the aforenoted U.S. application Ser. No. 703,382. The shutter 39 is also interposed in the deposition path until the source 26 is evaporating at a steady rate, at which point the shutter 39 opens the path of the evaporating source 26 to the plate assembly. While the magnesium oxide layer may range between 100 and 10,000 Angstroms, a preferred thickness to provide the desired low operating voltage and refractory function is between 2,000 and 4,000 Angstroms, while the preferred deposition rate is between 1300–1500 Angstroms per minute in a vacuum $10^{-6}$ Torr.

From the above description, it is apparent that the primary distinction between the instant invention and the prior art in the fabrication process is the deposition of the magnesium oxide overcoat on a substrate heated to a specific temperature range rather than the conventional process of applying it at room temperature (40° C.). However, significant differences derive from the testing and electrical parameters of the device. After fabrication in the manner described above, it is conventional to utilize a bakeout cycle prior to the backfill of the panel to eliminate impurities or residual gasses on the surface of the MgO overcoat. Thus the plates are sealed, placed under a vacuum and then backfilled with the aforenoted Penning gas mixture of neon-argon. The bakeout cycle associated with conventional fabrication requires that the panel be maintained at a temperature of 300° C. for 5 hours, but the total time including the required heating and cooling cycle is 16 hours for a panel. However, panels fabricated in accordance with the teaching of the instant invention require a bakeout cycle of only half the temperature (150° for 5 hours) vs the 300° for 16 hours utilized for conventional gas panels, thus providing a significant cost saving. In addition, panels fabricated using the teaching of the instant invention exhibited a significant improvement in reproducibility and thus raise the yield of panel assemblies. The deposition of magnesium oxide at the specified elevated temperature range produces a stable surface of dense and strainfree film, as compared to the film produced under the conventional manner which is porous and highly strained. As noted supra, when deposited at normal room temperature, water is incorporated into the body of the MgO film, whereas with the heated substrate, an extremely minuscule amount of water vapor is incorporated into the film.

When a panel has been fabricated as described above, a burn-in cycle is utilized to stabilize the operating voltages of the panel. In the normal burn-in cycle of conventional panels, all the cells in the panel are turned on with a voltage of 135 volts at a frequency of 30 KHz for a period of 7 hours. In panels fabricated in accordance with the teaching of the instant invention, the burn-in period is reduced from 7 hours to one hours, another significant saving of time which is translated into a corresponding reduction in cost.

Probably the most significant feature in gas panel operation relates to the static operating margin of the panel, which is defined as the difference between the maximum and minimum sustain voltage for the individual lines. Dynamic margin, on the other hand, relates to the corresponding values of the write or erase signal. Typical operating values for a gas panel may be 90 volts for $V_s$max. and 80 volts for $V_s$min. to provide a 10 volt "window" or margin, and the operating point is selected at some value between the $V_s$ max. and $V_s$ min. However, under test and operating conditions, the $V_s$ max. and $V_s$ min. values tend the converge, primarily from a lowering of the $V_s$max. value. One of the testing techniques employed in gas panel testing is designated as alternate line aging in which all the odd lines, both horizontal and vertical, are turned on for a period of up to 400 hours. These lines are then tested for $V_s$max. and $V_s$min. and compared with the values of the even lines, and generally a lowering of the maximum sustain voltage and a consequent lowering of the operating margin was noted.

With panels fabricated in accordance with the teaching of the instant invention, the $V_s$ max. demonstrated either the same voltage after test or even a slight increase as compared to the corresponding value before testing, and the $V_s$min. tended to remain constant such that the window or margin was either maintained at its original value or even increased. With a constant margin, the operating point of the panels can be maintained at a selected stable position, and detection apparatus or circuitry utilized to vary the operating point in accordance with the variation in the sustain values is unnecessary. Thus not only do a greater number of panels meet the prescribed specifications, but the life of the gas panel is substantially extended by eliminating the normally converging or drifting tendency of the sustain parameters under aging. In a number of panels constructed in accordance with the teaching of the instant invention and tested using the alternatie line aging technique described above, the operating margin of the panel was consistently observed to vary by less than one volt. It was also noted that very stable and reproducible panels were achieved presumably resulting from the fact that the MgO layer or film deposited at high substrate temperature is dense and bond strain-free. An additional advantage of depositing the magnesium oxide layer at elevated temperature is that the layer is found to be very stable and significantly less reactive with ambient during the panel fabrication processes.

While the invention has been particularly shown and described with reference to a preferred embodiment thereof, it will be understood by those skilled in the art that the foregoing and other changes in form and details may be made therein without departing from the spirit and scope of the invention.

We claim:

1. In a method for improving the operating margin of a gaseous discharge display device comprising an assembly of two sealed plates, the improvements comprising the steps of forming an array of conductors in a predetermined configuration on each of said plates, applying a layer of dielecric material over at least one of said conductor arrays, heating the assembly of said plates, said conductor arrays and said dielectric to a temperature range between 200° and 400° C., vapor depositing a layer of magnesium oxide onto the surface of the dielectric of said heated plate assembly, and sealing said plate assemblies about their edges to form a chamber therein, said plate assemblies being disposed such that the conductor arrays on said plate assemblies are substantially orthogonal to each other, the intersections of said conductors defining gaseous discharge cells.

2. A method a defined in claim 1 wherein said step of applying said dielectric material over said conductor arrays comprises spraying and reflowing of dielectric glass frit.

3. A method of the type defined in claim 2 including the further step of baking out said gaseous discharge display assembly in an evacuation chamber to remove impurities therein after the reflowing and cooling of said dielectric.

4. A method of the type claimed in claim 3 wherein said magnesium oxide deposition step on said heated plate assembly is applied by evaporating magnesium oxide in said evacuation chamber.

5. A method of fabricating a gaseous discharge display/storage device to improve the operating margin and reduce the burn-in cycle of said device comprising in combination, forming parallel conductor arrays on first and second glass plates of appropriate dimensions, applying a layer of dielectric glass over each of said conductor arrays to form first and second plate assemblies, heating said plate assemblies to a temperature of 200° C. to 400° C., vapor depositing a layer of magnesium oxide onto the surface of said dielectric on said heated plate assemblies, sealing said plate assemblies about their edges to form a chamber therein, said plate assemblies being disposed such that the conductor arrays on said plate assemblies are substantially orthogonal to each other, the intersections of said conductors defining gaseous discharge cells, evacuating said chamber and backfilling with an ionizable gas under a lower than atmospheric pressure, and firing and sustaining all said cells in said device for a time duration required for stabilization of the electric parameters of said device.

6. A method of the type defined in claim 5 wherein said layer of dielectric glass is applied by spraying and reflowing dielectric glass frit.

7. A method of the type defined in claim 5 wherein said layer of magnesium oxide is deposited by evaporating magnesium oxide crystals in a heated evacuated chamber.

8. A process for fabrication of a gaseous discharge display storage device comprising in combination disposing parallel lines as electrical conductors on glass plates of appropriate dimensions to define conductor arrays, applying a layer of insulating material over each of said conductor arrays to form glass plate assemblies, baking out said glass plate assemblies in a vacuum to remove impurities therefrom, heating said glass plate assemblies in a vacuum atmosphere to 200°–400° C., vapor depositing a layer of magnesium oxide onto the surface of said insulating material of each of said heated plate glass assemblies, cooling said coated plate glass assemblies, sealing a pair of said plate assemblies during an oven cycle to form a panel assembly wherein the parallel conductor arrays on one plate are disposed substantially orthogonal to the conductor arrays on said other plate and a uniform gap is provided in the chamber between the opposing surfaces of said plate assemblies, heating said panel assembly in an oven and simultaneously evacuating the chamber, backfilling said chamber through a tubulation member with an ionizable gas mixture under less than atmospheric pressure, and exciting said panel assembly with drive signals applied to said electrical conductors until the operating voltages have assymtotically approached their minimum value and the electrical parameters have stabilized.

* * * * *